US006112327A

United States Patent [19]

Shaffer

[11] Patent Number: 6,112,327

[45] Date of Patent: Sep. 5, 2000

[54] SWIMWEAR WITH FLOATATION MEMBERS

[75] Inventor: Christopher K. Shaffer, Agoura Hills, Calif.

[73] Assignee: Swimfree, LLC, Malibu, Calif.

[21] Appl. No.: 09/111,300

[22] Filed: Jul. 7, 1998

[51] Int. Cl.[7] ..... A41D 5/00

[52] U.S. Cl. ..... 2/67; 2/69; 2/DIG. 3; 441/120

[58] Field of Search ..... 2/67, 69, 1, 247–249, 2/DIG. 3; 441/102, 106, 116, 118, 113, 115, 114, 117, 120

[56] References Cited

U.S. PATENT DOCUMENTS

| | | | |
|---|---|---|---|
| 262,703 | 8/1882 | Sibley . | |
| D. 293,960 | 2/1988 | Bereson . | |
| 1,084,106 | 1/1914 | Pelton . | |
| 1,529,737 | 3/1925 | Elfenson . | |
| 1,547,097 | 7/1925 | Curle . | |
| 1,580,439 | 4/1926 | Meilland . | |
| 1,693,779 | 12/1928 | Franke . | |
| 1,742,368 | 1/1930 | Nunez . | |
| 1,800,960 | 4/1931 | Savard . | |
| 1,803,898 | 5/1931 | Diamond . | |
| 1,854,378 | 4/1932 | Mattson . | |
| 2,019,086 | 10/1935 | Milne . | |
| 2,197,228 | 4/1940 | Then . | |
| 2,346,019 | 4/1944 | Gerich . | |
| 2,490,556 | 12/1949 | Spack . | |
| 3,098,248 | 7/1963 | Geier . | |
| 3,130,424 | 4/1964 | Santangelo . | |
| 3,134,993 | 6/1964 | McCoy . | |
| 4,097,947 | 7/1978 | Kiefer . | |
| 4,397,636 | 8/1983 | Ganshaw | 441/65 |
| 4,619,622 | 10/1986 | McDonald et al. . | |
| 5,013,271 | 5/1991 | Bartlett . | |
| 5,030,153 | 7/1991 | Bailey . | |
| 5,184,968 | 2/1993 | Michalochick et al. | 441/116 |
| 5,295,765 | 3/1994 | Choi . | |
| 5,413,485 | 5/1995 | Adee . | |
| 5,452,477 | 9/1995 | Mann | 2/67 |
| 5,459,874 | 10/1995 | Meredith | 2/67 |
| 5,502,842 | 4/1996 | Wagner . | |
| 5,586,340 | 12/1996 | Russo . | |
| 5,605,482 | 2/1997 | Choy . | |
| 5,759,076 | 6/1998 | Bateman et al. . | |

FOREIGN PATENT DOCUMENTS

| | | |
|---|---|---|
| 316454 | 8/1929 | United Kingdom . |

*Primary Examiner*—Gloria M. Hale
*Attorney, Agent, or Firm*—Pretty, Schroeder & Poplawski

[57] ABSTRACT

A safety swimwear is provided, having a bodice portion, at least one floatation member or bladder and a protective panel securely affixed to the exterior of the bodice portion and holding the bladder. The panel is securely affixed to the exterior side of the bodice portion in a manner which draws attention to the presence of the floatation member and/or the level of deflation or inflation of the bladder. The panel may be of a contrasting appearance, such as, a contrasting color, texture and/or pattern, against the bodice portion to highlight the presence of the panel and particularly the bladder. In an embodiment of the swimsuit, two bladders and two panels are provided so that one bladder is securely affixed to a front piece of the swimsuit and another bladder is securely affixed to a back piece of the swimsuit. The bladders and thus the panels may be of different configurations. To buoy the wearer in an upright position, the bladders and the panels are positioned on the swimsuit to reside around the chest and back region of the wearer. Moreover, the chest bladder may be positioned relatively higher than the back bladder. In alternative embodiments, the panel may be securely, but removably, affixed to the bodice portion so that a damaged bladder may be replaced or the panel may accommodate a change in the size or volume of the bladder and/or be changed to a replacement or substitute panel.

41 Claims, 3 Drawing Sheets

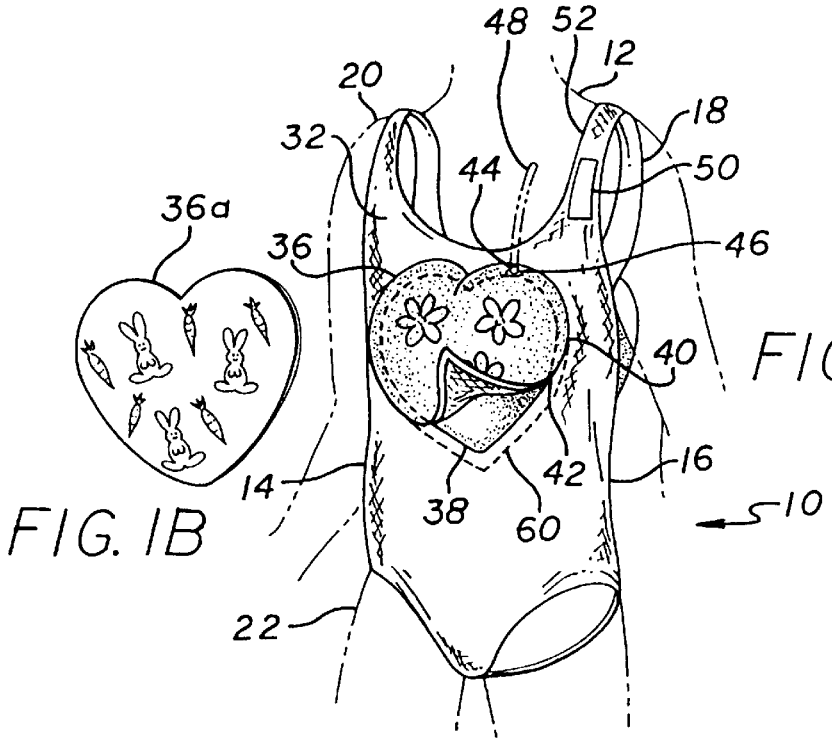
FIG. 1
FIG. 1B
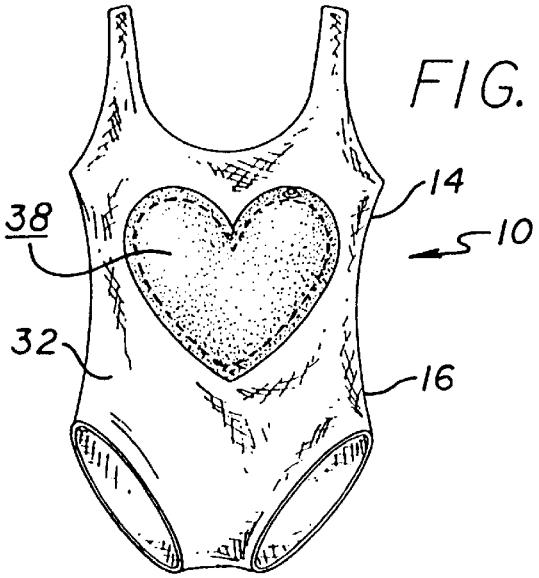
FIG. 2
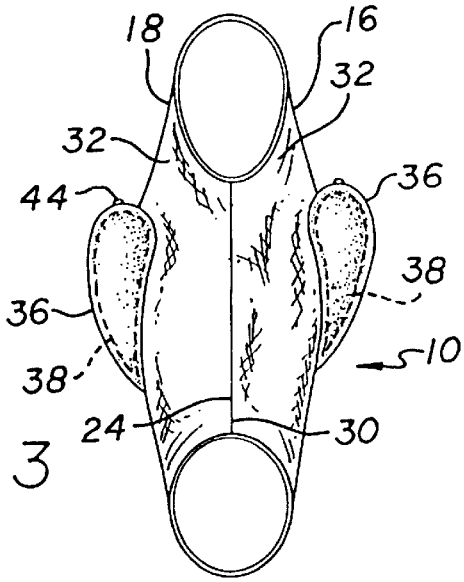
FIG. 3

FIG. 6A
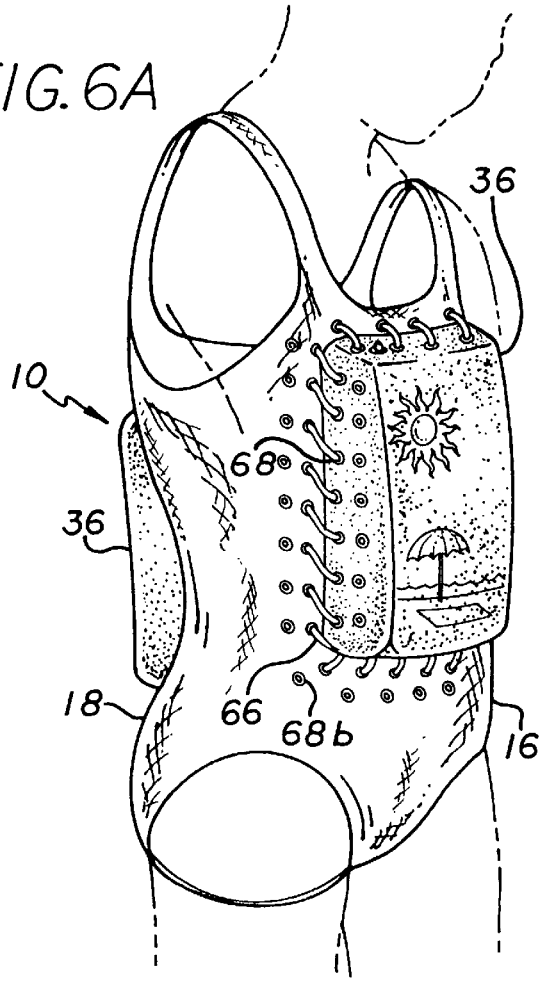
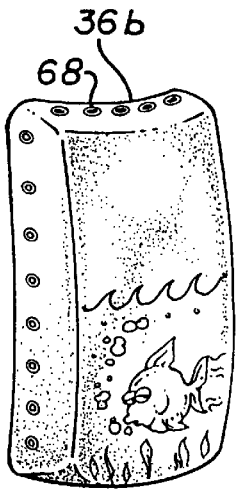
FIG. 6B
FIG. 7
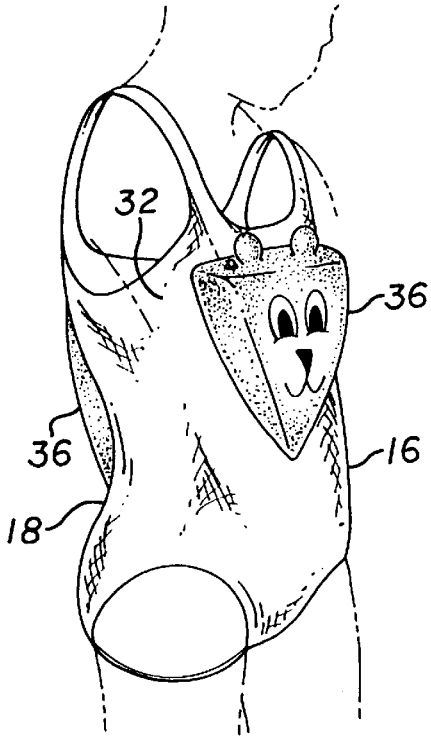
FIG. 8
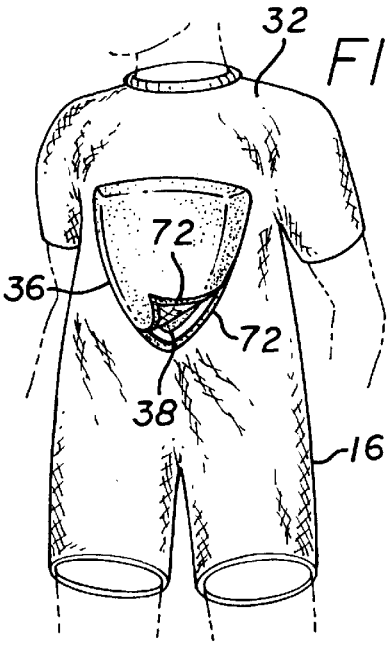

SWIMWEAR WITH FLOATATION MEMBERS

FIELD OF THE INVENTION

This invention relates to swimwear, in particular, swimwear for infants, toddlers and young children, equipped with floatation members providing buoyancy.

BACKGROUND OF THE INVENTION

Each year many people die from drowning or suffer other mishaps from water-related activities. A large portion consists of children who are simply playing near a body of water or learning how to swim. While numerous water safety devices are known, many fall short of providing equipment that is safe, convenient, comfortable, portable, child-friendly, inexpensive and tamper-resistant. For example, arm floatation devices are known; however, they do not comfortably support the wearer in water and may easily fall off the arms in turbulent conditions. Moreover, because these devices are separate and detached from swimsuits, they are often forgotten or left behind. Swimsuit equipped with inflatable or solid floatation members are also known. However, many of these swimsuits are bulky and uncomfortable. Not only can the inflatable or solid floatation members be readily removed by the children who wear such swimsuits or by the friends, but once removed the inflatable or solid floatation members are easily misplaced or lost.

Another major shortcoming of existing water safety devices is their appearance. Many children are reluctant to wear bulky, unattractive and uncomfortable floatation devices or swimwear. Many manufacturers have sought to hide or at least render less conspicuous the floatation devices of the swimsuit, with little success in reducing the stigma or embarrassment often associated with these devices. Also, many existing water safety devices are not readily adjustable in amount of the buoyancy provided. Thus, adjustments that may be desired when the wearer increases in size or weight, or improves in his or her swimming capabilities are not possible or at least readily facilitated. Furthermore, many existing safety swimsuits remain as conspicuously as safety swimsuits; that is, their appearance is essentially unalterable even with the floatation members removed. These suits remain easily recognizable as safety swimsuits.

Accordingly, there is a desire for a safety swimsuit that is safe, convenient, comfortable and portable in use and transport. It is also desired that the swimsuit be child-friendly, relatively inexpensive and be substantially tamper-resistant. It is further desired that the swimsuit be entertaining to the wearer to reduce his or her reluctance in wearing the swimsuit. In that regard, it is desirable that the swimsuit offers features which involve active participation of the wearer, particularly, infants, toddlers and young children.

SUMMARY OF THE INVENTION

The present invention is directed to a new and improved safety swimwear for infants, toddlers and young children, having a bodice portion, at least one floatation member or bladder and a protective panel securely affixed to the exterior of the bodice portion and holding the bladder. The panel is securely affixed to the exterior side of the bodice portion in a manner which draws attention to the presence of the floatation member and/or the level of deflation or inflation of the bladder, so that the same may be readily assessed by a supervising adult. The panel may be of a contrasting appearance, such as, a contrasting color, texture and/or pattern, against the bodice portion to highlight the presence of the panel and particularly the bladder. In this regard, the floatation feature of the swimsuit is not hidden or rendered inconspicuous, but rather accentuated for the benefit of the wearer and the supervising adult.

In an embodiment of the swimsuit, two bladders and two panels are provided so that one bladder is securely affixed to a front piece of the swimsuit and another bladder is securely affixed to a back piece of the swimsuit. The bladders are therefore separate and independent from each other, so that deflation in one does not cause deflation in the other. The bladders and thus the panels may be of different configurations. To buoy the wearer in an upright position, the bladders and the panels are positioned on the swimsuit to reside around the chest and back region of the wearer. In that regard, the chest bladder may be positioned relatively higher than the back bladder so that the wearer is buoyed with a slight inclination toward the supine position for better nose and mouth clearance above the waterline.

The panel of the swimsuit is securely affixed to the bodice portion so that the bladder is held securely to the swimsuit. As such, the swimsuit is essentially "self-contained" in that it is able to contain or hold the components of the swimsuit, thereby providing convenience and ease in use and transport. In alternative embodiments, the panel may be securely, but removably, affixed to the bodice portion, e.g., by stitches, laces, buttons, snaps, detachable rivets, Velcro® and/or zippers, so that a damaged bladder may be replaced or the panel may accommodate a change in the size or volume of the bladder and/or be changed to a replacement or substitute panel. The selection of a substitute panel displaying a different appearance from either or both of the original panel or the swimsuit may be used as enticement or entertainment to the wearer, thereby reducing reluctance or embarrassment typically associated with the donning of safety swimwear. Regardless of the panel used, the panel is securely affixed to the swimsuit in a manner such that the level of deflation/inflation of the bladder may be readily assessed.

The foregoing and other objects, features and advantages of the invention will be apparent from the following more particular description of the preferred embodiments, taken in conjunction with the accompanying drawings, which illustrate, by way of example, the principles of the invention.

BRIEF DESCRIPTION OF THE DRAWINGS

FIG. 1 is a perspective view of an embodiment of a swimsuit of the present invention;

FIG. 1B is a perspective view of a feature of the swimsuit of FIG. 1;

FIG. 2. is a front elevational view of the swimsuit of FIG. 1;

FIG. 3 is a side elevational view of the swimsuit of FIG. 1;

FIG. 6A is a perspective view of an alternative embodiment of a swimsuit of the present invention;

FIG. 6B is a perspective view of a feature of the swimsuit of FIG. 6A;

FIG. 7 is a perspective view of an alternative embodiment of a swimsuit of the present invention; and FIG. 8 is a perspective view of an alternative embodiment of a swimsuit of the present invention.

DETAILED DESCRIPTION

Figure 4:
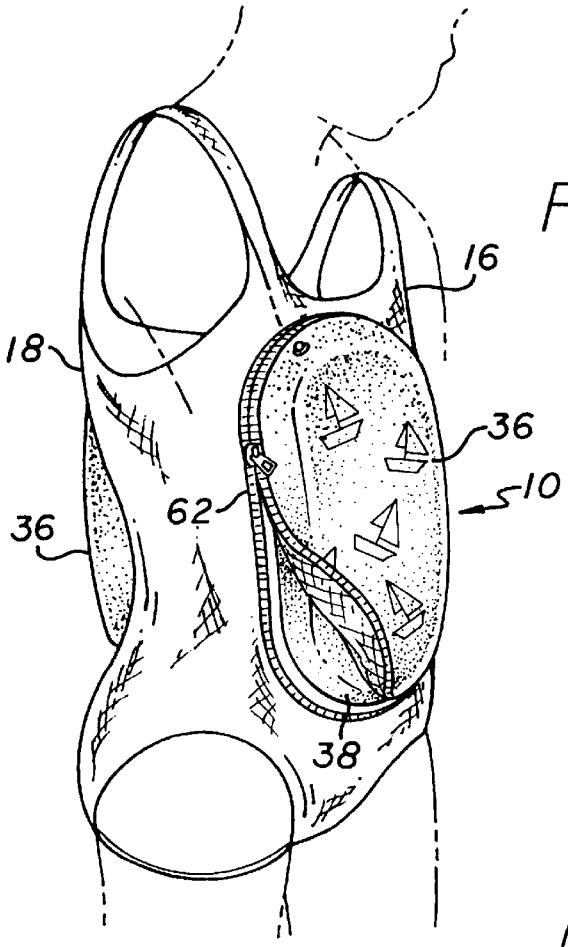
FIG. 4 is a perspective view of an alternative embodiment of a swimsuit of the present invention.

Referring to FIGS. 1, 2 and 3, a swimsuit 10 of the present invention is shown, being worn on a young child 12. The swimsuit 10 has a bodice portion 14 including a front piece 16 and a back piece 18, each of which extends lengthwise substantially from shoulders 20 of the child 12 to the bottom of the torso through legs 22 of the child. Sides 24 of the front piece 16 and back piece 18 are attached at seam 30 to form the bodice portion 12 substantially enclosing the body of the child. The bodice portion 12 is constructed of flexible and elastic fabric, e.g., comprising of 15% Lycra® and 85% nylon. Any fabric of appropriate stretching, elastic and/or breathability properties may be used, as known to one of ordinary skill in the art.

Securely affixed to exterior side 32 of each of the front piece 16 and back piece 18 is a panel 36 covering a floatation member, e.g., an inflatable bladder 38. As described in detail further below, the position and size of the bladder 38 (and thus the position and size of the panel 36) are selected to provide not only sufficient and appropriate buoyancy, but buoyancy in a desired manner. As for the panel 36 covering the bladder 38, the panel 36 may be constructed of the same flexible and elastic fabric of which the pieces 16 and 18 are constructed. The panel 36 may be securely affixed to the respective pieces 16 and 18 near or at its edge or periphery 40 to create a pocket 42 within which the bladder 38 is positioned and held. For illustrative purposes only, the panel 36 on the front piece 16 is shown partially affixed thereto, to better reveal the bladder 38 positioned and held in the pocket 42 between the panel 36 and the piece 16. With the bladder 38 positioned between the pieces 16 and 18 and the child 12, the pieces minimize any chaffing or irritation to the skin of the child.

The bladder may be inflated or deflated by lung power or a pump through a nozzle 44 that is inserted through an aperture 46 in the panel 36. The nozzle 44 is accessible to the child or another person notwithstanding the panel 36 covering the bladder 38. However, to prevent the bladder 38 from being readily deflated, the nozzle 44 may include a two-way safety valve as known in the art, such that deflation is not automatic upon opening or release of the nozzle, but requires manipulation of the nozzle in some predetermined way. Additionally, the nozzle 44 may include an extended tube 48 which is hidden under a flap 50 positioned on a shoulder portion or strap 52 of the swimsuit 10, as shown in FIG. 1. The flap 50 may be closed by buttons, snaps, Velcro®, laces, or the like.

In accordance with the present invention, the panel 36 is affixed to the outside or exterior side 32 of the pieces 16 and 18 where it is highly visible and conspicuous. In that regard, the fabric or material of the panel 36 may be of a contrasting appearance, e.g., different color, texture and/or pattern, from the fabric or material of the pieces 16 and 18 to highlight and create contrast with the bodice portion 14. For example, as shown in FIG. 1, the panel 36 has a floral pattern in contrast to a solid pattern on the front piece 16. As such, attention is purposefully drawn to the presence of the bladder 38 behind the panel 36, in particular, the state of the bladder, that is, whether it is deflated or inflated. So that the level of deflation or inflation of the bladder 38 may be readily assessed, the panel 36 may be configured to conform closely to the shape of the bladder, whereby it may be securely affixed to the pieces near or at its edge 40. Moreover, the elasticity and/or flexibility of the panel 36 permits the panel to closely conform to the shape and volume of the bladder 38 substantially regardless of the level of deflation or inflation.

Figure 5:
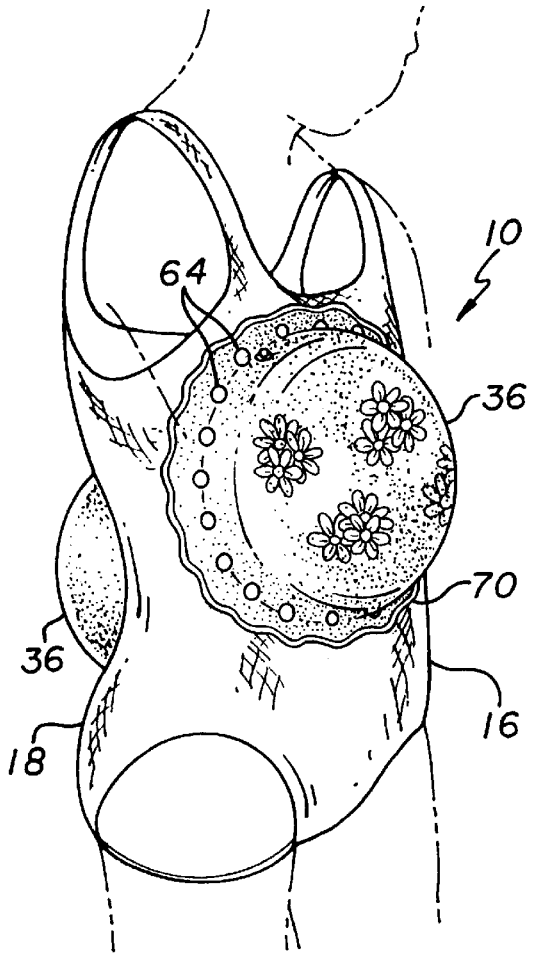
FIG. 5 is a perspective view of an alternative embodiment of a swimsuit of the present invention.

The panel 36 may be securely affixed to the pieces 16 and 18 in various manners. As shown in FIGS. 1 and 5, the panel 36 may be affixed by stitching, adhesion or rivets along 60. The bladder 38 may be positioned between the pieces 16 and 18 and the panel 36 prior to the affixation, or the bladder 38 may be inserted through an opening (not shown) made in the pieces 16 and 18 in the region of the bladder and into the pocket 42 after the affixation of the panel 36. Depending on the size of the opening, it can be closed or left open after the bladder has been inserted into the pocket.

In alternate embodiments of the swimsuit 10, the panel 36 may be securely, but removably, affixed to the pieces 16 and 18. In particular, the panel may be securely, but removably, affixed to the pieces by, for example, stitching (FIG. 1), one or more zippers 62 (FIG. 4), a plurality of buttons, snaps or detachable rivets 64 (FIG. 5), laces 66 (FIG. 6), Velcro® 72 (FIG. 8) and the like, or any combination thereof. Accordingly, the panel 36 may be detached and removed from the swimsuit 10 and replaced by a substitute panel **36*a* (FIG. 1B) having a contrasting appearance, such as, texture, pattern and/or color different, from the panel 36. In fact, multiple substitute or interchangeable panels 36*i* may be used with the swimsuit 10, or multiple swimsuits 10*i*, to provide a different combinations or different overall appearances whenever desired. Advantageously, when the wearer grows tired of a particular combination, the combination may be changed by changing the panels and/or the swimsuit. Particularly where the wearer is a young child, entertainment or amusement may be provided in the young child selecting a particular panel, or a particular combination of panel and swimsuit. Whereas children may be embarrassed and are therefore reluctant to don conventional safety swimsuits, the swimsuit of the present invention provides a swimsuit that involves active participation of the child and may therefore reduce the reluctance of the child to wear the swimsuit. In that regard, the use of the zippers 62, buttons/snaps/detachable rivets 64, laces 66, or Velcro® 72 allows the panels 36*i* to be readily changed without substantial compromise in the integrity or capability of the pocket 42 to hold and retain the bladder 38**.

The positioning and size of the bladder 38 are selected to provide sufficient and appropriate buoyancy and buoyancy in a desirable manner. The bladders, namely, their cross-sections, may be of different shapes, e.g., heart shaped (FIG. 1), circular (FIG. 5), rectangular (FIG. 6A), triangular (FIG. 7) or oval (FIG. 4). In general, the bladders 36 are sized to extend laterally across the chest and back for lateral stability. The width may be substantially constant as shown in FIGS. 4 and 6A, or may vary as shown in FIGS. 1, 5 and 7. Where the width decreases from the upper torso to the lower torso, the greatest width extends across the chest of the wearer, such as with the heart shape and the triangular shape, the lateral stability in the upright position may be improved.

Moreover, the bladder 38 of the front piece 16 may be positioned relatively higher, e.g., approximately 1.0 inch higher, than the bladder of the back piece 18 (see FIG. 3). For swimsuits used by infants, toddler or young children, the difference in positioning may be approximately 1.0 inch. In this manner, the wearer of the swimsuit is held substantially upright in the water, but slightly reclining. The mouth and nose of the wearer are therefore held upward, away from the surface of the water.

As for the buoyancy of the floatation members, e.g., the size or volume of the inflatable bladder 38, recommended U.S. Coast Guard standards for diving and swimming as set forth below may be applied:

| Weight | Recommended Lift |
|---|---|
| 50 lbs and under | total of 7 lbs of buoyancy |
| 50 lbs–90 lbs | total of 11 lbs of buoyancy |
| 90 lbs and over | total of 15.5 lbs of buoyancy |

Where the swimsuit has two bladders, that is, with the front piece 16 and the back piece 18, the total poundage of buoyancy may be evenly divided between the two bladders. For example, for a swimsuit using two bladders for a wearer of 50 lbs and under, each bladder may provide 3.5 lbs of buoyancy. For added buoyancy, the total poundage may be increased by approximately 30%. The bladders used in the front and back pieces 16 and 18 are separate and independent. Thus, the structural integrity of bladders remains separate and independent such that deflation or damage to one does not affect the other.

To vary the buoyancy provided by the swimsuit, such as when the wearer increases or decreases in weight, and/or improves his or her swimming ability, the bladder 38 may be further inflated or deflated. As mentioned, above, the panel 36 is affixed to the pieces 16 and 18 such that the pocket 42 readily conforms to the change in size and/or volume of the bladder 38. If the size and/or volume of the bladder 38 is changed, the swimsuit 10 can accommodate such change. For example, the laces 66 may be threaded through different sets of eyelets 68*b* (FIG. 6A). However, if a different bladder is used, or if the different sets of eyelets are unable to accommodate the change in size and/or volume of the bladder, the panel may be replaced by a panel 36*b* of a different size (see FIG. 6B). Again, the replacement or substitute panel 36*b* may be of a contrasting appearance, e.g., in texture, pattern, and/or color, than either or both of the panel 36 and the pieces 16 and 18.

Referring to FIG. 5, the panel 36 may also include a flange or extended portion 70, which may provide added decoration. That is, so long as the region of affixation (permanent or temporary) 60 of the panel 36 to the pieces 16 and 18 provides conformation between the panel 36 and the bladder 38, the panel 36 may be varied in shape and/or size relative to the bladder 38. Advantageously, where the bladder 38 is no longer desired, both of the panel 36 and the bladder 38 may be detached and removed from the swimsuit. For example, with the embodiment shown in FIG. 5, the panel 36 and the bladder 38 may be completely detached so that the buttons 64 remain on the swimsuit 10 as a decorative feature of an otherwise normal appearing swimsuit.

Although the foregoing discloses the presently preferred embodiments of the present invention, it is understood that the those skilled in the art may make various changes to the preferred embodiments shown and described without departing from the scope of the invention. For example, the bodice portion may provide shoulder portions and/or leg portions (see FIG. 8), and the floatation members and thus the panels of the front piece and the back piece need not be of the same configuration. Moreover, the panels may be decorated with faces of different characters (see FIG. 7). The invention is defined only by the following claims.

I claim:

1. A swimsuit comprising:

a bodice portion having an exterior side:

an inflatable bladder having a configuration;

a plurality of interchangeable panels each of which is adapted to be securely but removably affixed to said exterior side of said bodice portion, to hold said inflatable bladder between said exterior side and said panel.

2. A swimsuit of claim 1, wherein an exterior side of said panels has a contrasting appearance relative to said exterior side of said bodice portion.

3. A swimsuit of claim 1, wherein said panels are of different sizes.

4. A swimsuit of claim 1, wherein said configuration of said bladder includes a varying width.

5. A swimsuit of claim 1, wherein said configuration of said bladder includes a circular shape.

6. A swimsuit of claim 1, wherein said configuration of said bladder includes a heart shape.

7. A swimsuit comprising:

a bodice portion having a front piece and a back piece each having an exterior side;

a first bladder and a second bladder, said bladders having a configuration; and a first panel and a second panel, said first panel securely affixed to said front piece and holding said first bladder to said exterior side of said front piece, said second panel securely affixed to said back piece and holding said second bladder to said exterior side of said back piece, wherein said first and second panels are affixed respectively to said front and back pieces in a manner revealing a state of inflation or deflation of said bladders.

8. A swimsuit of claim 7, wherein said first and second panels are affixed respectively to said front and back pieces along a region closely conforming to said configuration of the bladders.

9. A swimsuit of claim 7, wherein said panels are of a contrasting appearance from the exterior sides of the bodice portion.

10. A swimsuit of claim 7, wherein said panels are of a different color than said exterior sides of the bodice portion.

11. A swimsuit of claim 7, wherein said panels are of a different texture than said exterior sides of the bodice portion.

12. A swimsuit of claim 7, wherein said panels are of a different pattern than said exterior sides of the bodice portion.

13. A swimsuit of claim 7, further comprising inflation nozzles connected to said bladders.

14. A swimsuit comprising:

a bodice portion;

a bladder; and a panel securely affixed to said bodice portion, said bladder positioned between said bodice portion and said panel, wherein said panel is affixed to said bodice portion in a manner revealing a state of inflation or deflation of said bladder.

15. A swimsuit of claim 14, wherein the bladder has a configuration and said panel is affixed to said bodice portion along a region closely conforming to said configuration of the bladder.

16. A swimsuit of claim 14, wherein said panel has a contrasting appearance relative to said bodice portion.

17. A swimsuit of claim 14, wherein said configuration of said bladder includes a heart shape.

18. A swimsuit comprising:

a bodice portion having a front and a back sides;

a front and a back floatation members, each being of a predetermined size; and a front and a back panel, said panels securely affixed to said respective sides of said bodice portion, said respective floatation members positioned between said respective sides and said respective panels, said panels being configured in close conformity to said respective floatation members and said sides being devoid of any additional floatation member of a comparable size to said front and back floatation members.

19. A swimsuit of claim 18, wherein a state of inflation/deflation of each of said floatation members is adjustable and said swimsuit is devoid of any additional floatation member whose state of inflation/deflation is adjustable.

20. A swimsuit of claim 18, wherein said state of inflation/deflation of each of said floatation members is independently adjustable.

21. A swimsuit of claim 14, wherein said panel is of a constrasting appearance from the bodice portion.

22. A swimsuit of claim 14, wherein said panel is of a different color than said bodice portion.

23. A swimsuit of claim 14, wherein said panel is of a different texture than said bodice portion.

24. A swimsuit of claim 14, wherein said panel is of a different pattern than said bodice portion.

25. A swimsuit of claim 14, further comprising an inflation nozzle connected to said bladder.

26. A swimsuit of claim 14, wherein said panel is configured substantially as a circle.

27. A swimsuit of claim 14, wherein said panel is configured substantially as a heart.

28. A swimsuit of claim 14, wherein said panel is configured substantially as a rectangle.

29. A swimsuit of claim 14, wherein said panel is configured substantially as a triangle.

30. A swimsuit of claim 14, wherein said panel is switched onto said bodice portion.

31. a swimsuit of claim 14, wherein said panel is removably affixed to said bodice portion.

32. A swimsuit of claim 14, further comprising a second bladder; and a second panel securely affixed to said bodice portion, said second bladder positioned between said bodice portion and said second panel, wherein said second panel is affixed to said bodice portion in a manner revealing a state of inflation or deflation of said second bladder.

33. A swimsuit of claim 32, wherein said first panel is affixed to a front bodice portion and said second panel is affixed to a back bodice portion.

34. A swimsuit of claim 14, wherein said panel is affixed to an upper torso region of said bodice portion.

35. A swimsuit of claim 14, wherein said panel is affixed to a chest region of said bodice portion.

36. A swimsuit of claim 18, wherein said panels are of a constrasting appearance from said sides of the bodice portion.

37. A swimsuit of claim 18, wherein said panels are of a different color than said sides of the bodice portion.

38. A swimsuit of claim 18, wherein said panels are of a different texture than said sides of the bodice portion.

39. A swimsuit of claim 18, wherein said panels are of a different pattern than said sides of the bodice portion.

40. A swimsuit of claim 18, wherein said floatation members comprise inflatable bladders.

41. A swimsuit of claim 18, further comprising inflation nozzles connected to said bladders.

* * * * *

UNITED STATES PATENT AND TRADEMARK OFFICE

CERTIFICATE OF CORRECTION

PATENT NO. : 6,112,327

DATED : September 5, 2000

INVENTOR(S) : Christopher K. Shaffer

It is certified that error appears in the above-identified patent and that said Letters Patent are hereby corrected as shown below:

Claim 30, line 1, "switched" should be -- stitched --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*